United States Patent [19]

Feuerlohn

[11] Patent Number: 4,506,497

[45] Date of Patent: Mar. 26, 1985

[54] METHOD AND DEVICE FOR METERING AND INJECTING SMALL AMOUNTS OF FLUID INTO THE SPLICING AIR OF A COMPRESSED GAS THREAD SPLICING DEVICE

[75] Inventor: Helmut Feuerlohn, Monchen-Gladbach, Fed. Rep. of Germany

[73] Assignee: W. Schlafhorst & Co., Monchen-Gladbach, Fed. Rep. of Germany

[21] Appl. No.: 576,124

[22] Filed: Feb. 2, 1984

[30] Foreign Application Priority Data

Feb. 2, 1983 [DE] Fed. Rep. of Germany ..... 3303419

[51] Int. Cl.[3] ..... D01H 15/00

[52] U.S. Cl. ..... 57/22

[58] Field of Search ..... 57/7, 22, 297

[56] References Cited

U.S. PATENT DOCUMENTS 3,407,583 10/1968 Irwin et al. ..... 57/22

3,822,538 7/1974 Cardell ..... 57/22

4,232,509 11/1980 Rohner et al. ..... 57/22 X 4,355,498 10/1982 Bertoli ..... 57/22

*Primary Examiner*—Donald Watkins

*Attorney, Agent, or Firm*—Herbert L. Lerner; Laurence A. Greenberg

[57] ABSTRACT

A method for metering and injecting small amounts of fluid into the splicing air of a splicing head of a compressed gas thread splicing device including a metering valve having a piston with a metering chamber formed therein, the metering chamber having a given volume determining the amount of fluid to be injected, the piston being slideable between a loading position and an injecting position of the metering chamber, a circulating fluid circuit connected to the piston, and a compressed gas circuit connected from the piston to the splicing head, which includes connecting the metering chamber to the circulating fluid circuit in the loading position before splicing, moving the piston from the loading position to the injecting position, and subsequently bringing the metering chamber in contact with a compressed gas current in the compressed gas circuit flowing into the splicing head as splicing air at the moment the fluid is to be injected for splicing, and a device for carrying out the method.

9 Claims, 1 Drawing Figure

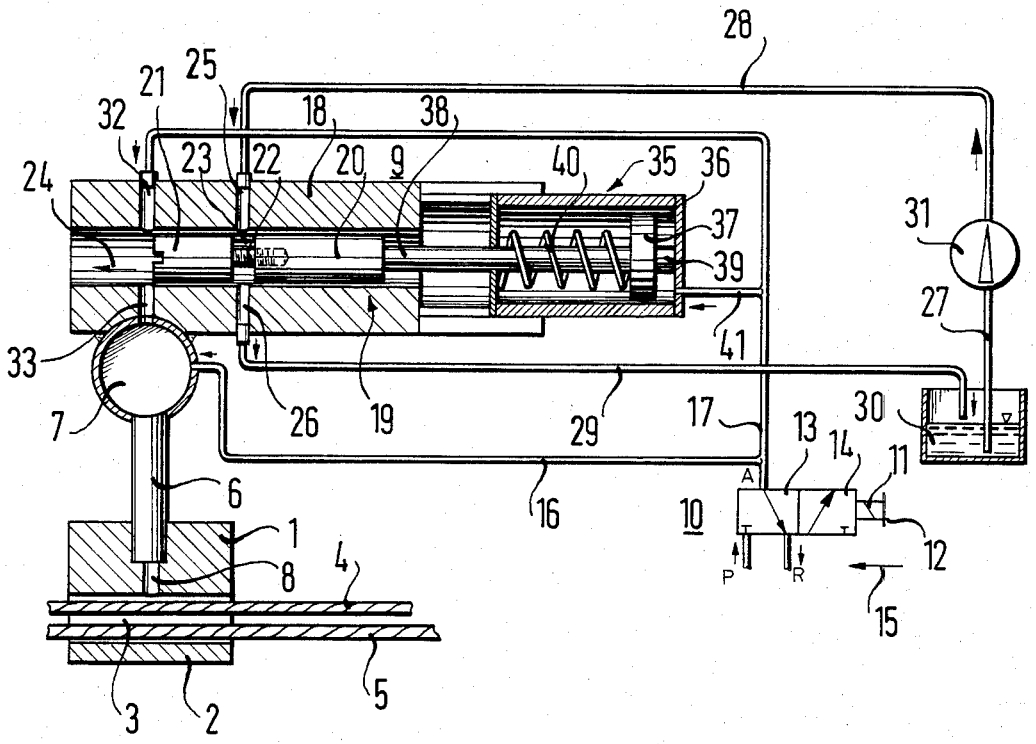
28
25
21
32
18
38
24
23
22
20
9
40
35
36
37
39
31
27
41
33
7
26
19
29
17
30
13
14
11
6
16
10
12
1
8
4
P
R
15
3
2
5

METHOD AND DEVICE FOR METERING AND INJECTING SMALL AMOUNTS OF FLUID INTO THE SPLICING AIR OF A COMPRESSED GAS THREAD SPLICING DEVICE

The invention relates to a method and a device for metering or dosing and injecting small amounts of fluid into the splicing air of a compressed gas thread splicing device with the aid of a metering or dosing valve.

Compressed gas thread splicing devices serve the purpose of connecting two or more threads with each other, by loosening the threads and splicing the loosened threads to each other with a surge of compressed gas. In order to produce a better splice connection which is more durable and has a better appearance, a small amount of fluid can be added to the air used for splicing. The problem is therefore to meter or dose this very small amount of liquid very accurately, to atomize it, and to introduce the metered or dosed amount in a well distributed manner into the splicing head of the compressed gas thread splicing device with the splicing air.

It is accordingly an object of the invention to provide a method and device for metering and injecting small amounts of fluid into the splicing air of a compressed gas thread slicing device, which overcomes the hereinafore-mentioned disadvantages of the heretofore-known methods and devices of this general type, and to simply add a very accurately metered small amount of fluid to the compressed gas which is used for making the splice, in a well distributed manner and at the point in time at which the splicing takes place.

With the foregoing and other objects in view there is provided, in accordance with the invention, a method for metering and injecting small amounts of fluid into the splicing air of a splicing head of a compressed gas thread splicing device including a metering valve having a piston with a metering chamber formed therein, the metering chamber having a given volume determining the amount of fluid to be injected, the piston being slideable between a loading position and an injecting position of the metering chamber, a circulating fluid circuit connected to the piston, and a compressed gas circuit connected from the piston to the splicing head, which comprises connecting the metering chamber to the circulating fluid circuit in the loading position before splicing, moving the piston from the loading position to the injecting position, and subsequently bringing the metering chamber in contact with a compressed gas current in the compressed gas circuit flowing into the splicing head as splicing air at the moment the fluid is to be injected for splicing.

The advantages obtained through the use of the invention are to be seen especially in the fact that not only are a very accurate dosing and good atomization of the metered fluid achieved, but that furthermore, this can be done at the right moment for forming the mixture, so that the fluid which is suspended in the compressed gas reaches the fibers at the splice at the best moment, and that there is no time left for these components to separate.

In accordance with another mode of the operation, there is provided a method wherein the compressed gas circuit includes a bypass line and a connection for changing the position of the piston, which comprises moving the piston with a compressed gas current in the compressed gas circuit flowing into the splicing head, for bringing the fluid-filled metering chamber into contact with a compressed gas current in the bypass line flowing into the splicing head at the moment the fluid is to be injected.

In order to carry out the method, there is provided a device for metering and injecting small amounts of fluid into the splicing air of a splicing head of a compressed air splicing device, comprising a metering valve having a valve housing with a fluid inlet, a fluid outlet, an air inlet and an air outlet formed therein, a piston disposed in said housing, the piston having a metering chamber disposed therein with a volume determining the amount of fluid to be injected, the piston being slideable in the housing between a loading position and an injecting position of the metering chamber, a fluid container, a pump, a fluid circuit connected from the fluid container through the pump to the fluid inlet and from the fluid outlet to the fluid container, an air control valve, and a compressed gas line connected from the air control valve to the air inlet and from the air outlet to the splicing head, the metering chamber being connected to the fluid inlet and fluid outlet in the loading position, and the metering chamber being connected to the air inlet and air outlet in the injecting position.

In accordance with a further feature of the invention, the compressed gas line includes a line leading from the air outlet to the splicing head.

In accordance with an added feature of the invention, the metering valve includes a control device connected to the piston, and including means connected from the air control valve to the control device for controlling the control device in synchronism with the air control valve.

In accordance with an additional feature of the invention, the control device includes a control cylinder, a control piston connected to the piston of the metering valve, and a spring biasing the control piston into an end position against the controlling means.

In accordance with again another feature of the invention, the air control valve has an outlet, and the controlling means are in the form of an additional compressed gas line connected from the control cylinder to the outlet of the air control valve.

In accordance with again a further feature of the invention, the piston includes two parts and a central pin interconnecting the parts being adjustable in length, the metering chamber having an adjustable annular shape defined by the parts and the pin.

In accordance with a concomitant feature of the invention, there is provided another compressed gas line leading directly from the outlet of the air control valve to the splicing head, the first-mentioned compressed air line being connected to the outlet of the air control valve, and the additional compressed gas line being a branch line leading from the first-mentioned compressed gas line to the control cylinder.

The circulatory flow of the fluid ensures that the metering chamber is free of air in the loading position, because the flowing fluid takes the air remaining from the injection position along with it.

This is the prerequisite to obtaining a very accurately metered dose. The metered amount spontaneously enters the flow of compressed gas, is rapidly carried along and is atomized. This takes place at the time that the splice is made, while the splicing air is already flowing.

Since the metering valve is relatively small, the metered amount does not have to be injected into the main current of the compressed gas. The flow velocity of the main flow may also be relatively slow. For this reason it is proposed to conduct a bypass flow of compressed gas through the metering valve. A reliable atomization is therefore assured, and the mixture of bypass air and fluid is again united with the main gas current, so that a better mixture of the components is achieved as a total result.

Since it is possible for the control valve of the compressed gas thread splicing device to also control the metering valve, all synchronization difficulties or timing problems can be avoided. The whole metering valve including its control mechanism is simple and sturdy. The metering chamber can be easily, but very accurately, adjusted for the desired volume.

Other features which are considered as characteristic for the invention are set forth in the appended claims.

Although the invention is illustrated and described herein as embodied in a method and device for metering and injecting small amounts of fluid into the splicing air of a compressed gas thread splicing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is a diagrammatic and schematic view of an embodiment of the invention.

Referring now to the single FIGURE of the drawing in detail, there is seen a compress-gas thread splicing device, which is not shown in all of its details, but which includes a splicing head 1, which can be closed by a cover 2 thus forming a splicing chamber 3. As shown in the FIGURE, the splicing chamber 3 has received threads 4 and 5 which are to be spliced with each other. The end 6 of a line 7 discharges in the splicing head 1 at an outlet opening 8. In this case, compressed air is to be used for splicing and is to be enriched with a small, accurately metered or dosed amount of fluid in finely distributed form, at the point in time at which the splice is made. A metering or dosing valve designated with reference numeral 9 is provided for this purpose and is shown in the drawing on an enlarged scale, as compared to the remainder of the device.

The point in time at which the splice is made and the duration of the splicing operation, are determined by a control valve 10. The control valve is provided with a compressed air connection P, a relief port R, and an outlet port A. The drawing shows the control valve 10 with the compressed air connection P closed. When the control valve 10 is activated by means of an electromagnetic drive 11 or a push button 12, parts 13 and 14 of the valve 10 move in the direction of an arrow 15, so that the part 14 moves into the position of the part 13. After this takes place, the compressed air connection P is connected to the outlet port A in the interior of the control valve 10, and the relief port R is closed. The compressed air at the outlet port A can therefore reach the line 7 through a compressed gas line 16. Additionally, another compressed gas line, in the form of a bypass line 17, leads from outlet port A to the metering valve 9, and from there to the line 7.

The metering or dosing valve 9 is provided within a valve body 18 with a slideably supported piston 19, which is formed of two parts 20 and 21. The two parts of the piston are connected with each other by a central pin 22, the free length or distance of which between the parts 20, 21 can be adjusted. The pin 22 has a thread which engages in a threaded hole provided in the part 20. A wider or narrower annular metering chamber 23 is formed between the two parts of the piston 19, depending on the degree to which the part 20 approaches the part 21, by turning the pin 22.

By sliding the piston 19, the metering chamber 23 can be moved from a loading position shown, in direction of an arrow 24, to an injecting position. In the loading position, as shown, the metering chamber 23 is connected to an inlet 25 of the valve 9 and an outlet port 26 of the valve 9 which are connected to a line 27, 28, 29, which leads from a fluid container 30 through a pump 31 and through the metering valve 9, back to the fluid container 30. In the injecting position, the metering chamber 23 is connected to an inlet port 32 of the valve 9 and to an outlet port 33 of the valve 9, which are connected to the compressed gas bypass line 17, which leads from the control valve 10 through the metering valve 9 and the line 7 to the splicing head 1.

The metering valve 9 is provided with a control device 35 which is in connection with the piston 19. The control device 35 includes a control cylinder 36 and a control piston 37. The control piston 37 is connected to the piston 19 by a piston rod 38. In the rest or end position, the control piston 37 lies against a stop 39. This rest or end position is secured by a spring 40. The control cylinder 36 is connected to the bypass line 17 by a compressed gas line 41 which is a branch line.

The drawing shows the device in a condition in which it is ready to make a splice. The pump 31 is in operation, and the metering chamber 23 is filled with fluid without bubbles. The two threads 4 and 5 are ready to be spliced, and have been inserted into the splicing chamber 3.

If the control valve 10 is operated while the device is in this condition, the following occurs:

Compressed air flows from the valve 10 which has been moved to the left, through the lines 16 and 17, as well as through the line 41 from the line 17. The pressure in the control cylinder 36 which is thus increased, causes the control piston 37 to move rapidly to the left along with the parts attached thereto, thus moving the metering chamber 23 from the loading position to the injecting position. Meanwhile, compressed air is already flowing through the inlet 32. This flow is interrupted for a short time by the part 21 of the piston 19, but thereafter the air flow passes through the metering chamber 23 at full strength, pulling along the metered quantity of fluid accumulated there, which is injected into the line 7 that is immediately adjacent the metering valve 9, together with the compressed air. The moisture-laden air in the line 7 is combined with the air coming directly through the compressed gas line 16. The combined and intermixed air flows enter through the outlet opening 8 into the splicing chamber 3, and perform the splicing connection with the two threads 4 and 5 in the chamber 3. After a short, predetermined splicing time, the control valve 10 is moved back to the right to its starting position as shown, whereby the discharge of the control cylinder 36 is effected through the lines 41 and 17 to the relief port R. The piston 19 then moves to its starting position again by the action of the spring 40, and the metering chamber 23 can again be filled with fluid. By allowing a short time for purging, it can be ensured that no air bubbles remain in the metering chamber 23. The device is therefore again ready for splicing.

The invention is not limited to the illustrated and described typical embodiment which was used as an example.

For example, it can be of advantage to elongate the part 21 of the piston, to a length which is long enough to ensure that the inlet port 32 and the outlet 33 are closed in the rest position.

I claim:

1. Method for metering and injecting small amounts of fluid into the splicing air of a splicing head of a compressed gas thread splicing device including a metering valve having a piston with a metering chamber formed therein, the metering chamber having a given volume determining the amount of fluid to be injected, the piston being slideable between a loading position and an injecting position of the metering chamber, a circulating fluid circuit connected to the piston, and a compressed gas circuit connected from the piston to the splicing head, which comprises connecting the metering chamber to the circulating fluid circuit in the loading position before splicing, moving the piston from the loading position to the injecting position, and subsequently bringing the metering chamber in contact with a compressed gas current in the compressed gas circuit flowing into the splicing head as splicing air at the moment the fluid is to be injected for splicing.

2. Method according to claim 1, wherein the compressed gas circuit includes a bypass line and a connection for changing the position of the piston, which comprises moving the piston with a compressed gas current in the compressed gas circuit flowing into the splicing head, for bringing the fluid-filled metering chamber into contact with a compressed gas current in the bypass line flowing into the splicing head at the moment the fluid is to be injected.

3. Device for metering and injecting small amounts of fluid into the splicing air of a splicing head of a compressed air splicing device, comprising a metering valve having a valve housing with a fluid inlet, a fluid outlet, an air inlet and an air outlet formed therein, a piston disposed in said housing, said piston having a metering chamber disposed therein with a volume determining the amount of fluid to be injected, said piston being slideable in said housing between a loading position and an injecting position of said metering chamber, a fluid container, a pump, a fluid circuit connected from said fluid container through said pump to said fluid inlet and from said fluid outlet to said fluid container, an air control valve, and a compressed gas line connected from said air control valve to said air inlet and from said air outlet to the splicing head, said metering chamber being connected to said fluid inlet and fluid outlet in said loading position, and said metering chamber being connected to said air inlet and air outlet in said injecting position.

4. Device according to claim 3, wherein said compressed gas line includes a line leading from said air outlet to the splicing head.

5. Device according to claim 3, wherein said metering valve includes a control device connected to said piston, and including means connected from said air control valve to said control device for controlling said control device in synchronism with said air control valve.

6. Device according to claim 5, wherein said control device includes a control cylinder, a control piston connected to said piston of said metering valve, and a spring biasing said control piston into an end position against said controlling means.

7. Device according to claim 6, wherein said air control valve has an outlet, and said controlling means are in the form of an additional compressed gas line connected from said control cylinder to said outlet of said air control valve.

8. Device according to claim 3, wherein said piston includes two parts and a central pin interconnecting said parts and having a portion disposed between said parts being adjustable in length, said metering chamber having an adjustable annular shape defined by said parts and said pin.

9. Device according to claim 7, including another compressed gas line leading directly from said outlet of said air control valve to said splicing head, said first-mentioned compressed air line being connected to said outlet of said air control valve, and said additional compressed gas line being a branch line leading from said first-mentioned compressed gas line to said control cylinder.

* * * * *